US005501937A

United States Patent [19]

Matsumoto et al.

[11] Patent Number: 5,501,937

[45] Date of Patent: Mar. 26, 1996

[54] HEAT MODE THERMAL TRANSFER RECORDING MATERIAL

[75] Inventors: Shinji Matsumoto; Atsushi Nakajima; Katsumi Maejima; Sota Kawakami; Koichi Nakatani, all of Hino, Japan

[73] Assignee: Konica Corporation, Tokyo, Japan

[21] Appl. No.: 334,802

[22] Filed: Nov. 4, 1994

Related U.S. Application Data

[63] Continuation of Ser. No. 41,444, Apr. 1, 1993, abandoned.

[30] Foreign Application Priority Data

Apr. 14, 1992 [JP] Japan ..... 4-094422
Oct. 9, 1992 [JP] Japan ..... 4-271880

[51] Int. Cl.[6] ..... B41M 5/26

[52] U.S. Cl. ..... 430/200; 430/201; 430/199; 430/945; 428/195; 428/913; 428/914; 503/227

[58] Field of Search ..... 430/200, 201, 430/199, 945; 428/195, 913, 914; 503/227

[56] References Cited

U.S. PATENT DOCUMENTS

| | | | |
|---|---|---|---|
| 4,735,839 | 4/1988 | Sato et al. | 430/945 |
| 4,818,591 | 4/1989 | Kitamura et al. | 428/914 |
| 4,927,693 | 5/1990 | Koshizaka et al. | 428/195 |
| 4,942,141 | 7/1990 | DeBoer et al. | 428/195 |
| 4,973,572 | 11/1990 | DeBoer | 430/201 |
| 5,036,040 | 7/1991 | Chapman et al. | 430/201 |
| 5,100,711 | 3/1992 | Satake et al. | 430/945 |
| 5,171,650 | 12/1992 | Ellis et al. | 430/201 |
| 5,178,990 | 1/1993 | Satake et al. | 430/945 |
| 5,192,737 | 3/1993 | Kubodera et al. | 430/201 |
| 5,212,146 | 5/1993 | Komamura et al. | 428/195 |
| 5,232,817 | 8/1993 | Kawakami et al. | 430/201 |
| 5,273,800 | 12/1993 | Satake et al. | 430/270 |

FOREIGN PATENT DOCUMENTS

| | | |
|---|---|---|
| 0321923 | 6/1989 | European Pat. Off. . |
| 0366461 | 5/1990 | European Pat. Off. . |
| 0454083 | 10/1991 | European Pat. Off. . |
| 63-104881 | 5/1988 | Japan . |
| 2-292088 | 12/1990 | Japan . |

*Primary Examiner*—Charles L. Bowers, Jr.
*Assistant Examiner*—Martin J. Angebranndt
*Attorney, Agent, or Firm*—Frishauf, Holtz, Goodman, Langer & Chick

[57] ABSTRACT

Disclosed is a heat mode thermal transfer recording material comprising a support having thereon at least a light-heat converting layer containing a water-soluble colorant and an ink layer. The heat mode thermal transfer recording material is capable of forming transferred images excellent in color reproduction.

12 Claims, 3 Drawing Sheets

HEAT MODE THERMAL TRANSFER RECORDING MATERIAL

This application is a Continuation of application Ser. No. 08/041,444, filed Apr. 1, 1993, now abandoned.

FIELDS OF THE INVENTION

The present invention relates to a heat mode thermal transfer recording material, particularly to a heat mode thermal transfer recording material capable of forming transferred images excellent in color reproduction by use of a light source such as a laser.

Further, the present invention relates to a light-heat converting type heat mode recording material capable of forming accurate images, particularly to a recording material which can keep a faithful color reproducibility without lowering sensitivity even after a long-term storage.

BACKGROUND OF THE INVENTION

In thermal transfer recording, pressing and heating transfer with a thermal head has so far been widely practiced. In recent years, however, there has come to be used, as a method capable of forming images with much higher resolution, a thermal transfer recording method comprising a laser beam irradiation on a thermal transfer recording material to convert the irradiated laser beam into heat necessary to transfer images. This laser thermal transfer recording method, which is termed the heat mode thermal transfer recording method, can sharply raise the resolution as compared with the thermal transfer recording method which uses a thermal head to supply heat energy, because laser beams supplied as energy can be condensed to several microns in diameter.

However, when used in forming color images, this heat mode thermal transfer recording method has a problem that a localized large amount of energy given by a laser beam induces transfer or scatter of a light-heat converting material contained in a heat mode thermal transfer recording material and thereby causes a color turbidness in a transferred image.

Though Japanese Pat. O.P.I. Pub. Nos. 2074/1990, 34891/1991 and 36094/1991 disclose techniques on light-heat converting materials, these techniques all use sublimation dyes and their basic constituents transfer only dyes; moreover, there is no clear description whether or not a light-heat converting layer is present, not to mention use of water-soluble colorants.

SUMMARY OF TEE INVENTION

An object of the present invention is to provide a heat mode thermal transfer recording material, which does not induce any explosive developing due to thermal decomposition or fusion of a light-heat converting layer and thereby prevents transfer of the layer, even when a large energy is locally applied.

Another object of the present invention is to provide a heat mode thermal transfer recording material, which has a sensitivity adapted for laser beams and a capability of transferring images without causing any color turbidness and thereby can form images excellent in color fidelity.

The present inventors have continued a study and found that the above objects of the invention are attained by making the light-heat converting layer of a thermal transfer recording material highly heat resistant.

(1) A heat mode thermal transfer recording material comprising a support having thereon at least a light-heat converting layer containing a water soluble colorant and an ink layer.

(2) A heat mode thermal transfer recording material as defined in (1), wherein the water soluble colorant is a colorant soluble in water not less than 0.1 wt %.

(3) A heat mode thermal transfer recording material as defined in (1), wherein the water soluble colorant has a sulfo group.

(4) A heat mode thermal transfer recording material as defined in (1), wherein the water soluble colorant is a near infrared-absorptive dye having an absorption peak at wavelengths longer than 700 nm.

(5) A heat mode thermal transfer recording material as defined in (1), wherein the water-soluble light-heat converting layer contains a water-soluble binder or a water-borne resin emulsion.

(6) A heat mode thermal transfer recording material as defined in (1), wherein the thickness of the light-heat converting layer is not more than 1.0 μm.

(7) A heat mode thermal transfer recording material as defined in (1), wherein the thickness of the ink layer is not more than 1.0 μm.

Another object of the present invention is to provide an ink sheet which is high in sensitivity, free from aggregation of dyes in the coating process of a light-heat converting layer as well as aggregation of dyes in a long-term storage, and thereby capable of forming images without color turbidness and sensitivity deterioration.

The above object of the invention is attained by the following constituents (1) and (2):

(1) A light-heat converting type heat mode recording material to form ink images by the steps of making the ink face of a light-heat converting type heat mode recording material contact with the image receiving face of a light-heat converting type heat mode recording material and irradiating light imagewise, wherein the light-heat converting type heat mode recording material has at least a support, a light-heat converting layer and an ink layer, and the light-heat converting layer contains a water-soluble, infrared-absorptive dye and gelatin, methyl cellulose and polyvinyl alcohol.

(2) A light-heat converting type heat mode recording material as defined in (1), wherein the light-heat converting layer contains a hardener.

EXPLANATION OF SIGNS

1: support

2: image receiving layer

3: ink layer

4: light-heat converting layer

5: peelable layer

6: cushioning layer

Figure 2:
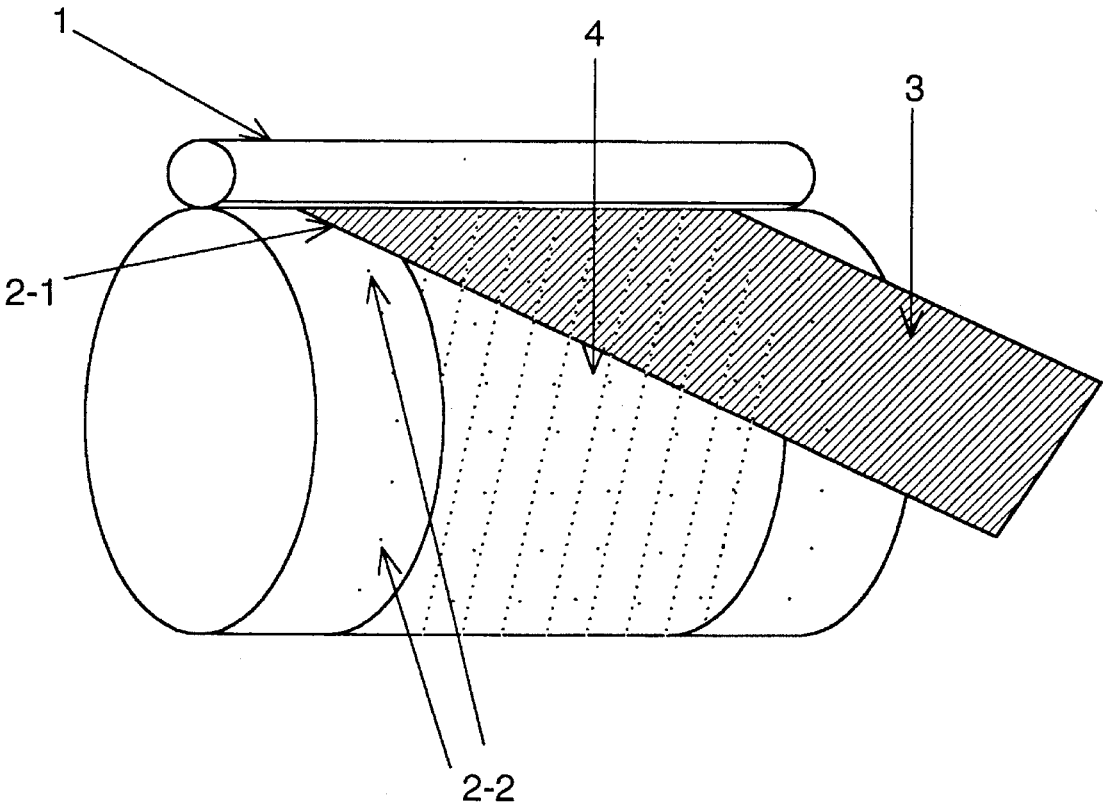
Figure 3:
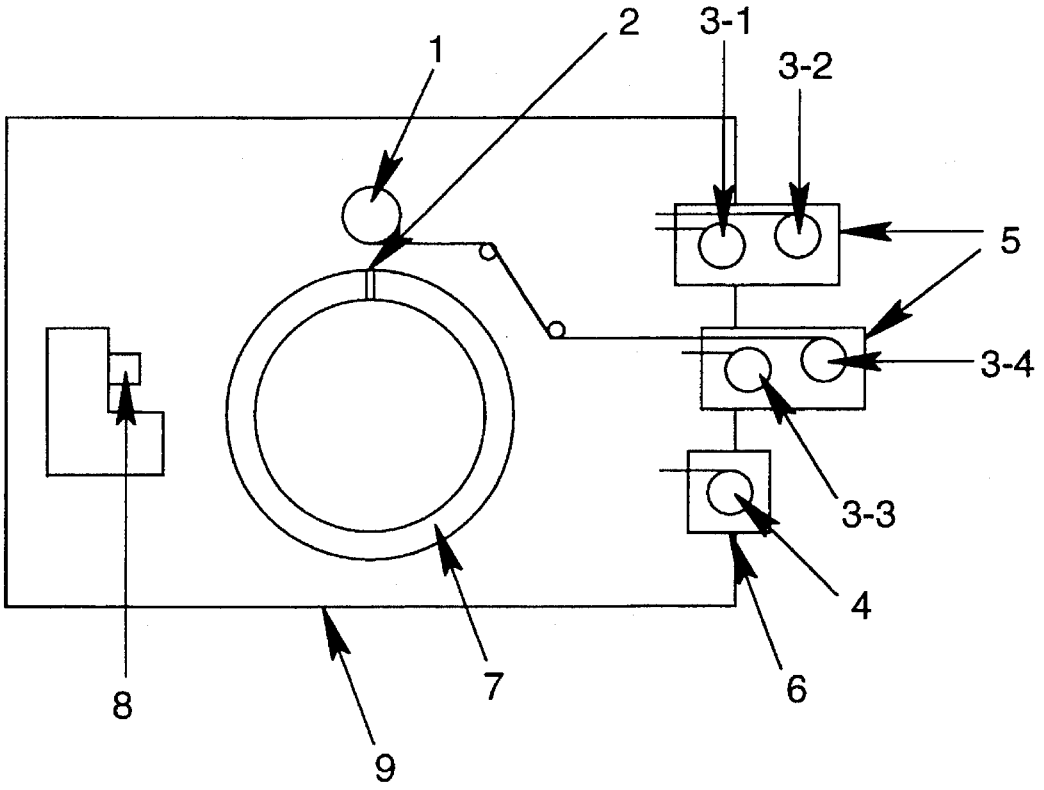

FIG. 2: a perspective view of a light-heat converting heat mode image receiving material and recording material of the invention which are wound around the drum-shaped evacuator FIG. 3: a schematic diagram of the drum-shaped evacuator and its peripheral devices FIG. 4(*a*): a relationship between light-heat converting layer thickness and energy necessary to transfer.

FIG. 4(*b*): a relationship between ink layer thickness and energy necessary to transfer.

Explanation of Signs

1: pressure roll

2: evacuating hole (2-1 shows an open state, 2-2 a closed state)

3: heat mode recording material (3-1 shows a yellow recording material, 3-2 a magenta one, 3-3 a cyan one and 3-4 a black one)

4: heat mode image receiving material

5: heat mode recording material feeding means

6: heat mode image receiving material feeding means

7: holding portion of the evacuator

8: optical writing means

9: housing

DETAILED DESCRIPTION OF THE PREFERRED EMBODIMENT

Next, the component layers of the light-heat converting type heat mode recording material are described.

(A) Support

Any type support can be used as long as it has a sufficient dimensional stability and can withstand the temperature at which images are formed. Typical examples include the films and sheets described in the 12th to 18th lines of the lower left column of page 2 of Japanese Pat. O.P.I. Pub. No. 193886/1988. But, when image are formed by irradiating laser beams from the recording material side, the support of the recording material is preferably transparent. To form images by irradiating laser beams from the image receiving material side, the support of the recording material does not need to be transparent. The thickness of the support is not particularly limited, but it is usually 2 to 300 μm, preferably 5 to 200 μm.

In order to impart running stability, heat stability and antistatic property, a backing layer may be provided on the reverse side (opposite to the side bearing an ink layer) of a support. Such a backing layer can be formed by coating on a support a backing layer coating solution prepared by dissolving a resin such as nitrocellulose in a solvent, or dissolving or dispersing in a solvent a binder resin and fine particles 20 to 30-μm.

(B) Cushioning layer

A cushioning layer may be provided for the purpose of closer contact between the recording material and the image receiving material. This cushioning layer is a layer having a heat softening property or resilience, which is formed of a material capable of softening and transforming sufficiently upon heating, a material of low elastic modulus, or a material having a rubber-like resilience. Typical examples thereof include elastomers such as natural rubbers, acrylate rubbers, butyl rubbers, nitrile rubbers, butadiene rubbers, isoprene rubbers, styrene-butadiene rubbers, chloroprene rubbers, urethane rubbers, silicone rubbers, acrylic rubbers, fluorine-containing rubbers, neoprene rubbers, chlorosulfonated polyethylenes, epichlorohydrine rubbers, EPDMs (ethylene-propylene-diene rubber), urethane elastomers; and resins such as polyethylenes, polypropylenes, polybutadienes, polybutenes, high-impact ABS resins, polyurethanes, ABS resins, acetates, cellulose acetates, amide resins, polytetrafluoroethylenes, nitrocellulose, polystyrenes, epoxy resins, phenol-formaldehyde resins, polyester resins, high-impact acrylic resins, styrene-butadiene copolymers, ethylene-vinyl acetate copolymers, acrylonitrile-butadiene copolymers, vinyl chloride-vinyl acetate copolymers, polyvinyl acetates, plasticized polyvinyl chloride resins, vinylidene chloride resins, polyvinyl chlorides, and polyvinylidene chloride resins.

Further, these materials may also be incorporated in a support to give cushioning properties to the support itself.

The cushioning layer can be formed by coating a solution or a latex-like dispersion of the above material with a blade coater, roll coater, bar coater, curtain coater or gravure coater, by extrusion lamination of a molten material, or by laminating a sheet of the above material on a base.

The cushioning layer increases contact of an image transfer medium with an image receiving medium, when these media are subjected to vacuum contacting, or undergo heat softening or lowering of elastic modulus by laser beam irradiation. A preferred thickness of the cushioning layer is 1 to 50 μm.

(C) Light-heat converting layer

The light-heat converting layer may be provided adjacent to the ink layer.

The material of the light-heat converting layer, though it depends upon the type of a light source, is preferably a substance which can absorb light and convert it into heat at a high efficiency. When a semiconductor laser is used as light source, preferred substances are those having absorption bands in the near infrared region, such as phthalocyanine dyes, squalium dyes, azulenium dyes, nitroso compounds and metal salts thereof, polymethine dyes, dithiol metal complex dyes, triarylmethane dyes, indoaniline metal complex dyes, naphthoquinone dyes and anthraquinone dyes. Typical examples thereof include the compounds described in Japanese Pat. O.P.I. Pub. Nos. 139191/1988 and 103476/1991.

Among these compounds, water-soluble polymers are preferred because of their good releasability to an ink layer, high heat resistance during laser beam irradiation, and low scattering property when subjected to excessive heating. To use a water-soluble polymer in the light-heat converting layer, it is preferable to modify a light-heat converting material to a water-soluble one by means of introducing a sulfo group or the like, or to disperse it in water. Among water-soluble polymers, gelatin, methyl cellulose and polyvinyl alcohol are each preferably used because it hardly coagulates water-soluble infrared-absorptive dyes, allows stable coating of a light-heat converting layer, and prevents color turbidness due to coagulation of infrared-absorptive dyes as well as sensitivity deterioration during storage.

As described above, water-soluble polymers, especially gelatin, methyl cellulose and polyvinyl alcohol are each preferably used as a binder for the light-heat converting layer according to the invention. Gelatin has an effect of preventing coagulation of infrared-absorptive dyes when compared with other water-soluble binders. In view of preservability, use of a hardener is preferred.

Further, raising the releasability between the light-heat converting layer and the ink layer improves sensitivity; therefore, it is preferable to add various peeling agents to the light-heat converting layer. Usable peeling agents are silicone type peeling agents (polyoxyalkylene modified silicone oils, alcohol modified silicone oils, etc.), fluorine-containing surfactants (perfluorophosphate type surfactants) and other various surfactants.

The thickness of this light-heat converting layer is preferably 0.1 to 3 μm, especially 0.2 to 1.0 μm. The content of light-heat converting material in the light-heat converting layer can be set so as to give an absorbance of 0.3 to 3.3, preferably 0.7 to 2.5, at the wavelength of a light source usually used in image recording.

If the adhesion of the light-heat converting layer to the cushioning layer is poor, delamination occurs at the time of thermal transfer or removal of an image receiving sheet, making the color of images turbid. To avoid this, an adhesive layer may be provided between the cushioning layer and the light-heat converting layer. The material of such an adhesive layer has to be selected so as to make the adhesion of light-heat converting layer to adhesive layer, and adhesive layer to cushioning layer larger than the peeling strength of ink layer at the time of transferring ink. In general, conventional adhesives such as polyesters, polyurethanes and gelatin can be advantageously used. When an adhesive layer of poor cushioning or poor heat-softening is used, the effect of the cushioning layer is depressed; therefore, it is preferable that the adhesive layer be as thin as possible. Further, use of a thin adhesive layer allows the cushioning layer to change easily in shape in the vacuum contacting process, or to be readily heated to a softening point by laser beam irradiation. Of course, it needs a certain thickness to provide a necessary adhesion. Accordingly, the thickness is preferably not more than 0.5 μm; however, the thickness is not necessarily confined to this as long as the adhesive layer allows the cushioning layer to function adequately.

(D) Ink layer

The ink layer means a layer which contains a colorant and a binder and can be melted or softened upon heating and transferred in its entirety, but thorough melting is not necessary in transferring.

As colorants, inorganic pigments, organic pigments and dyes can be used.

As inorganic pigments, there can be employed titanium dioxide, carbon black, graphite, zinc oxide, Prussian blue, cadmium sulfide, iron oxide, and chromates of lead, zinc, barium and calcium. Suitable organic pigments are pigments of azo type, thioindigo type, anthraquinone type, anthanthraquinone type, vat dye pigments, phthalocyanine pigments (e.g., copper phthalocyanine) and derivatives thereof, and Quinacridone pigments.

Suitable organic dyes include acid dyes, substantive dyes, disperse dyes, oil-soluble dyes, metal-containing oil-soluble dyes, and sublimation dyes.

The colorant content of the ink layer is not particularly limited, but it is usually 5 to 70 wt %, preferably 10 to 60 wt %.

As binders in the ink layer, there may be used those contained in conventional heat-fusible ink materials such as heat-fusible materials, heat-softening materials and thermoplastic resins.

Typical examples of the heat-fusible materials include vegetable waxes such as carnauba wax, japan wax, auricurt wax; animal waxes such as beeswax, insect wax, shellac, spermaceti; petroleum waxes such as paraffin wax, microcrystalline wax, polyethylene wax, ester wax, acid wax; and mineral waxes such as montan wax, ozokerite, ceresine. In addition to these waxes, there can also be used higher fatty acids such as palmitic acid, stearic acid, margaric acid, behenic acid; higher alcohols such as palmityl alcohol, stearyl alcohol, behenyl alcohol, margaryl alcohol, melissyl alcohol, eicosanol; higher fatty acid esters such as cetyl palmitate, melissyl palmitate, cetyl stearate, melissyl stearate; amides such as acetamide, propionamide, palmitamide, stearamide, amidowax; and higher amines such as stearylamine, behenylamine, palmitylamine.

Examples of the thermoplastic resins include resins such as ethylene copolymers, polyamide resins, polyester resins, polyurethane resins, polyolefins, acrylic resins, polyvinyl chloride resins, cellulosic resins, rosinous resins, polyvinyl alcohols, polyvinyl acetals, ionomer resins, petroleum resins; elastomers such as natural rubbers, styrene-butadiene rubbers, isoprene rubbers, chloroprene rubbers, diene-copolymers; rosin derivatives such as ester gum, rosin-maleic resins, rosin-phenol resins, hydrogenated rosins; and polymeric compounds such as phenolic resins, terpene resins, cyclopentadiene resins, aromatic hydrocarbon resins.

Usable binders include ethylene vinylacetate copolymer, phenol resins; vinyl resins such as polyvinyl alcohols, polyvinyl formals, polyvinyl butyrals, polyesters, polyvinyl acetates, polyacrylamides, polyvinyl acetacetals, polystyrene resins, styrene copolymer resins, polyacrylates, acrylate coplymers; and rubber type resins, ionomer resins, polyolefin resins, rosinous resins. Among them, polystyrene resins, styrene copolymer resins, polyacrylates, rubber type resins are preferred for their high acid resistances.

A heat-softening ink layer having a desired heat-softening or heat-fusible point can be formed by selecting appropriate heat-fusible materials and thermoplastic materials from the above examples. In a recording material used in a two-step transfer mode which comprises a primary transfer of the ink layer itself to a smooth image receiving sheet and a secondary transfer of an ink image alone to a desired rough paper (art paper, coat paper, fine paper, etc.), it is preferable to use a styrene-(meth)acrylic acid (or ester) copolymer resin as binder resin for ink layer (Japanese Pat. Appl. No. 142801/1992) and a polyolefin image receiving layer as image receiving layer, in order to obtain a high sensitivity in the primary image transfer and a high efficiency in the secondary image transfer.

In the ink layer, a variety of additives can be added within the range not harmful to the effect of the invention. Examples thereof include releasing compounds such as silicones, silicone oils (including reaction-curing types), silicone-modified resins, fluororesins; peelable compounds such as surfactants and waxes; fillers such as metal powders, silica gel, metal oxides, carbon black, resin powders; curing agents reactive to binder components (e.g., isocyanates, acrylates, epoxides); waxes and thermal solvents.

As solvents, there can be used ketones such as acetone, methyl ethyl ketone, cyclohexanone; esters such as ethyl acetate, amyl acetate, dimethyl phthalate, ethyl benzoate; aromatic hydrocarbons such as toluene, xylene, benzene; halogenated hydrocarbons such as carbon tetrachloride, trichloroethylene, chlorobenzene; ethers such as diethyl ether, methyl cellosolve, tetrahydrofuran; and dimethylformamide, dimethylsulfoxide.

The thickness of the ink layer is preferably 0.2 to 2 μm, especially 0.3 to 1.5 μm.

(E) Image receiving material

The image receiving material forms an image by receiving a heat-fusible ink layer peeled imagewise from the foregoing recording material. The image receiving material has usually a support and an image receiving layer, but it is occasionally made up from a support alone.

Since the heat-fusible ink layer is transferred in a hot molten state, the image receiving material must have an adequate heat resistance as well as a good dimensional stability to form an image appropriately.

The face of the image receiving material, which is brought into contact with a recording material at the time of image formation, is adequately smooth or properly roughened. In concrete terms, when the heat-fusible ink layer's surface of a recording material is roughened with a matting material, etc., the image receiving material's face which contacts the heat-fusible ink layer should be adequately smooth; when the heat-fusible ink layer's surface is not roughened, the image receiving material's face which contacts the heat-fusible ink layer should not to be roughened. Further, both of the image receiving material's face and the heat-fusible ink layer's face may be roughened.

As with the above ink layer (the above light-heat converting heat mode recording material), it is preferable for the image receiving material to have a support and a cushioning layer. And an image receiving layer is provided on such a cushioning layer to make an image receiving material. The support is desirably formed from a material of good dimensional stability. The cushioning layer may be formed of the same high molecular compounds as those of the cushioning layer in the ink material, but a slightly different function is required of materials for the image receiving material cushioning layer. In vacuum contacting, both cushioning layers are the same in the function to undergo elastic (plastic) deformation and thereby make a close contact with each other; but, in thermal deforming due to laser beam irradiation, the amount of heat accepted by the image receiving material cushioning layer is less than that accepted by the ink material cushioning layer, because the heat generated in a light-heat converting layer reaches the image receiving material cushioning layer through the ink material and the image receiving layer, and, quantity of heat transfer is poor. Accordingly, it is preferable that the high molecular compound used in the image receiving material cushioning layer have a lower softening point. Suitable materials are thermoplastic resins and thermoplastic elastomers of which softening points are not higher than 150° C. In the case of re-transfer of an image transferred onto a temporary image receiving material to rough paper by means of lamination or the like, the cushioning layer must have a capability of softening at the laminating temperature and a thickness larger than the depth of irregularities on the rough paper. The image receiving layer is preferably formed of a resin having an affinity for ink binders, and the ink binder resin can be used as it is. It is preferable to make the thickness of the image receiving layer thin within the limit not harmful to the cushioning layer's function. Preferably, the thickness is 5 μm or less, but it is not restrictive as long as the image receiving layer itself has a cushioning function. In carrying out a secondary transfer of only an ink image to rough paper, it is preferable to employ the foregoing ink layer binder and image receiving layer binder. In the case of performing a secondary transfer of an ink image together with an image receiving layer to rough paper, a peelable layer may be provided between the image receiving layer and the cushioning layer for an efficient secondary transfer. Further, there may be used the techniques described with respect to the ink material for improving the running property, antistatic property, antiblocking property and coating property.

The image receiving material is made up from a binder, various additives added according to specific requirements, and the foregoing cushioning material.

As binders, there can be used adhesives such as ethylene-vinyl chloride copolymer adhesives, polyvinyl acetate emulsion adhesives, chloroprene adhesives, epoxy resin adhesive; tackifiers such as natural rubbers, chloroprene rubbers, butyl rubbers, acrylate polymers, nitrile rubbers, polysulfides, silicone rubbers, rosinous resins, polyvinyl chloride resins, petroleum resins, ionomers; and reclaimed rubbers, SBR, polyisoprenes, polyvinyl ethers.

The cushioning layer to be provided between the support and the image receiving layer is the same as the cushioning layer defined in the foregoing recording material.

There are no particular restrictions on the thickness of a support which carries thereon the cushioning layer and the image receiving layer and on the thickness of a support which constitutes an image receiving material by itself. The cushioning layer has the same thickness as the cushioning layer in the recording material. The thickness of the image receiving layer is usually 0.1 to 20 μm, but not limited to this when the cushioning layer is used as image receiving layer.

As a material for a cushioning layer, a material identical to that used for the ink sheet (the light-heat converting heat mode recording material) may be used.

Further, a heat mode thermal transfer recording material (hereinafter occasionally referred to as a recording material) can be fundamentally formed by laminating on a support a light-heat converting layer containing a light-heat converting material and an ink layer in that order. An intermediate layer (a cushioning layer, peelable layer barrier layer, etc.) may be provided between the light-heat converting layer and the ink layer.

In the invention, a water-soluble colorant is used as a light-heat converting material which converts light into heat. Suitable water-soluble colorants are those having an acid group such as a sulfo group (—$SO_3H$), a carboxyl group (—COOH) or a phosphono group (—$PO_3H_2$) and those having a sulfonamido bond or a carbonamido bond. Of them, those having a sulfo group are preferred.

Suitable colorants, though they depend upon light sources, are those which can absorb light and convert it into heat energy at a high efficiency. When a semiconductor laser is used as light source, for example, preferred colorants are those having an absorption in the near infrared region. In such a case, there can be used a variety of cyanine dyes and the dyes of anthraquinone type, indoaniline metal complex type, azulenium type, squalium type, dithiol metal complex type, chelate type, naphthalocyanine type. Particularly preferred are those represented by one of the following formulas (1) to (12):

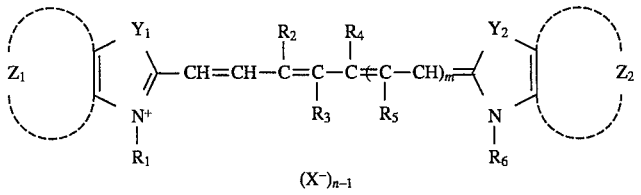

Formula (1)

-continued

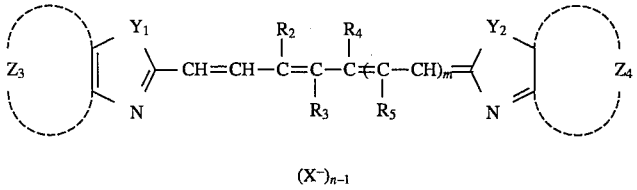

Formula (2)

In formulas (1) and (2) , $Z_1$ and $Z_2$ each represent an atomic group necessary to form a substituted or unsubstituted pyridine ring, a substituted or unsubstituted quinoline ring, a substituted or unsubstituted benzene ring or a substituted or unsubstituted naphthalene ring; ($a{=}N^+(R_1)$— bond or a —$N(R_6)$— bond may be contained in $Z_1$ or $Z_2$ when $Z_1$ or $Z_2$ represents a pyridine ring or a quinoline ring).

$Z_3$ and $Z_4$ each represent an atomic group necessary to form a substituted or unsubstituted quinoline ring or a substituted or unsubstituted pyridine ring, and may contain in the ring of $Z_3$ and $Z_4$ $a{=}N^+(R_1)$— bond or a —$N(R_6)$— bond.

$Y_1$ and $Y_2$ each represent a dialkyl-substituted carbon atom, a vinylene group, an oxygen, sulfur or selenium atom, or a nitrogen atom bonded with a substituted or unsubstituted alkyl or aryl group.

$R_1$ and $R_6$ each represent a substituted or unsubstituted alkyl group; $R_2$, $R_4$ and $R_5$ each represent a hydrogen atom, a substituted or unsubstituted alkyl group; $R_3$ represents a hydrogen atom, a halogen atom, a substituted or unsubstituted alkyl group, or a substituted or unsubstituted aryl group or a nitrogen atom bonded with an alkyl or aryl group.

But at least one of the groups represented by $Z_1$ to $Z_4$ and $R_1$ to $R_6$ is substituted by at least one of sulfo, carboxyl and phosphono groups (preferably sulfo group).

$X^-$ represents an anion; m represents 0 or 1; n represents an integer of 1 or 2, provided that n is 1 when the dye forms an inner salt.

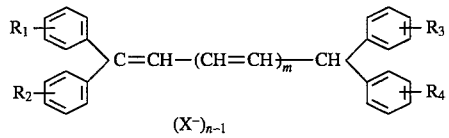

Formula (3)

In the formula, $R_1$, $R_2$, $R_3$ and $R_4$ each represent a substituted or unsubstituted alkyl group, —$N(R_5)(R_6)$, $=N^+(R_5)(R_6)$ or a sulfo group; $R_5$ and $R_6$ each represent a substituted or unsubstituted alkyl group, provided that at least one of the groups represented by $R_1$ to $R_6$ is substituted by at least one of sulfo, carboxyl and phosphono groups (preferably sulfo group); $X^-$ represents an anion.

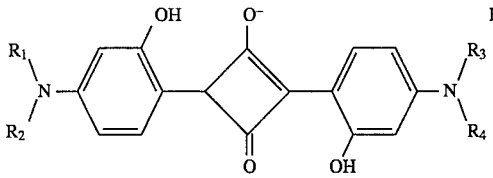

Formula (4)

In the formula, $R_1$, $R_2$, $R_3$ and $R_4$ each represent a substituted or unsubstituted alkyl group, and at least one of them is substituted by at least one of the acid groups of sulfo, carboxyl and phosphono groups (preferably sulfo group).

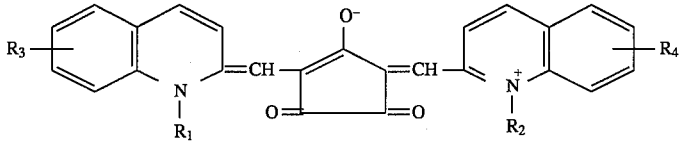

Formula (5)

In the formula, $R_1$ and $R_2$ each represent a substituted or unsubstituted alkyl group, at least one of which is substituted by at least one of the acid groups of sulfo, carboxyl and phosphono groups (preferably sulfo group); $R_3$ and $R_4$ each represent a hydrogen atom or an alkyl group which may be substituted by one of the acid groups of sulfo, carboxyl and phosphono groups (preferably sulfo group).

Formula (6)

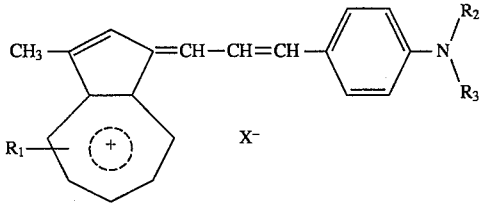

In the formula, $R_1$, $R_2$ and $R_3$ each represent a substituted or unsubstituted alkyl group, at least one of which is substituted by at least one of the acid groups of sulfo, carboxyl and phosphono groups (preferably sulfo group); $X^-$ represents an anion.

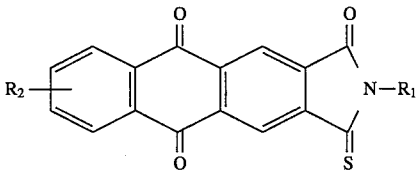

Formula (7)

In the formula, $R_1$ and $R_2$ each represent a sulfo, carboxyl or phosphono group, or an alkyl or aryl group substituted with one of such acid groups.

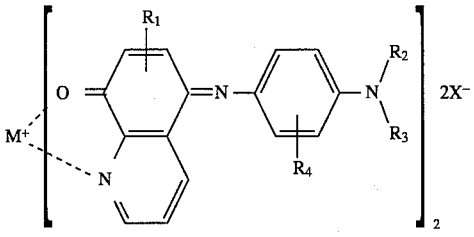

Formula (8)

In the formula, $R_1$ represents a hydrogen atom, an amido, amino, alkyl, sulfo, carboxyl or phosphono group, or an alkyl group substituted by one of such groups; $R_2$ and $R_3$ each represent an alkyl group or an alkyl group substituted by at least one of sulfo, carboxyl and phosphono groups; $R_4$ represents a hydrogen atom, a sulfo, carboxyl or phosphono group, or an alkyl group substituted by one of these groups; M represents a metal atom (preferably Cu or Ni); $X^-$ represents an anion.

Formula (9)

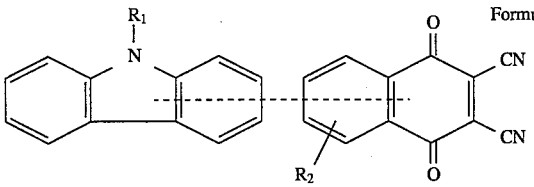

In the formula, $R_1$ represents a hydrogen atom or an alkyl group substituted by one of sulfo, carboxyl and phosphono groups; $R_2$ represents an alkyl, amido, nitro, sulfo, carboxyl or phosphono group.

Formula (10)

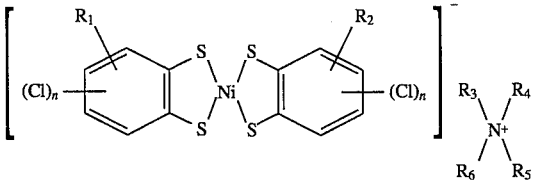

In the formula, $R_1$ and $R_2$ each represent a sulfo, carboxyl or phosphono group or an alkyl group substituted by one of these groups; n represents 2 or 3; $R_3$, $R_4$, $R_5$ and $R_6$, which may be the same or different, each represent an alkyl group.

Formula (11)

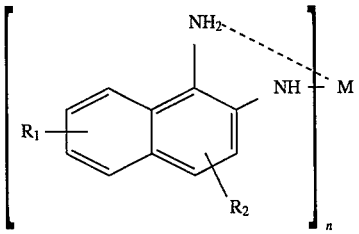

In the formula, $R_1$ and $R_2$ each represent a hydrogen atom, a sulfo, carboxyl or phosphono group or an alkyl group substituted by one of them, provided that $R_1$ and $R_2$ are not hydrogen atoms concurrently; M represents a divalent or trivalent metal atom; n represents an integer of 2 or 3.

Formula (12)

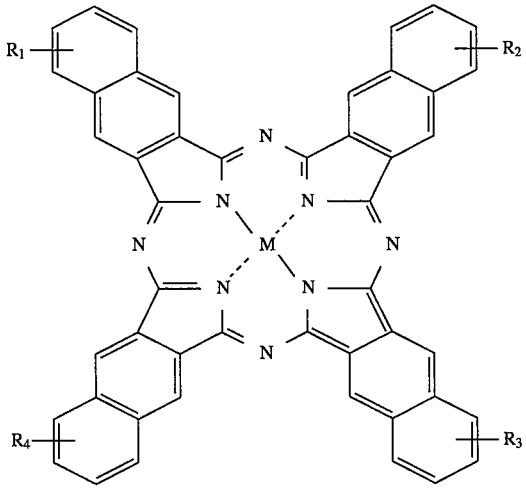

In the formula, $R_1$, $R_2$, $R_3$ and $R_4$ each represent a hydrogen, a sulfo, carboxyl or phosphono group or an alkyl group substituted by one of them, provided that all of $R_1$ to $R_4$ are not hydrogen atoms concurrently; M represents a divalent metal atom.

Typical examples of the compounds represented by formulas (1) to (12) are as follows but not limited to them.

(1)

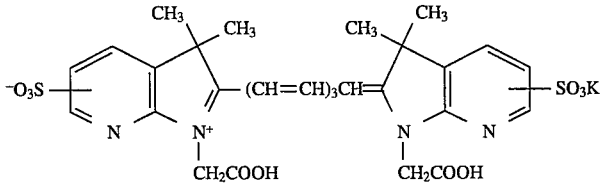

(2)

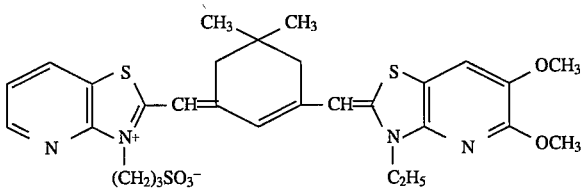

(3)

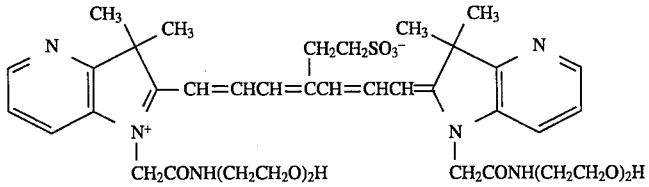

-continued
(4)
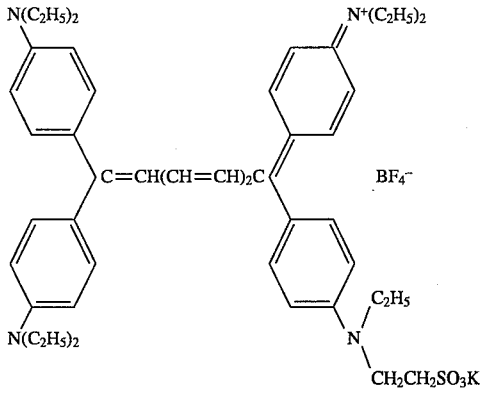
(5)
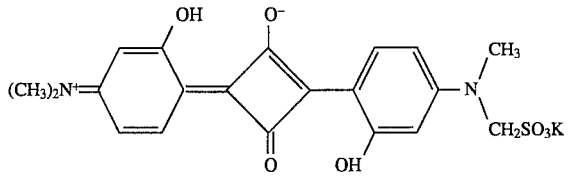
(6)
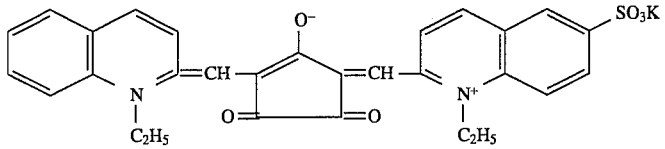
(7)
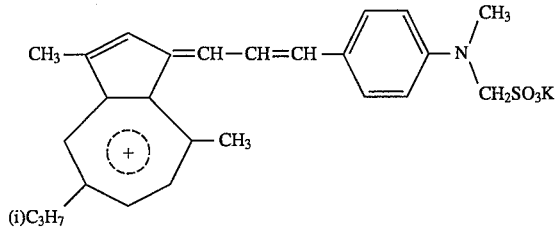
(8)
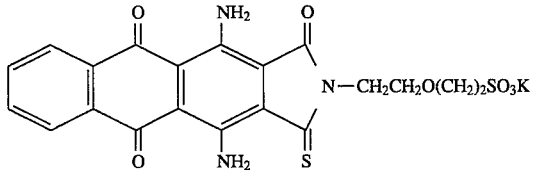
(9)
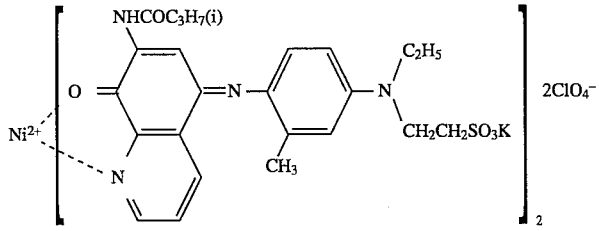
(10)
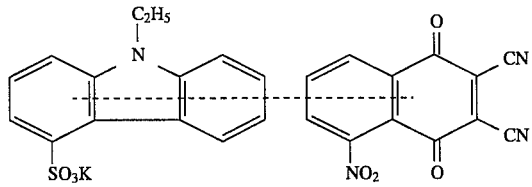

-continued

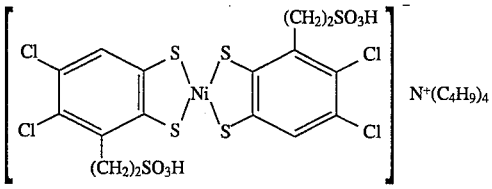

(11)

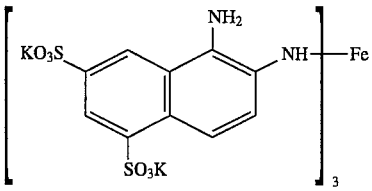

(12)

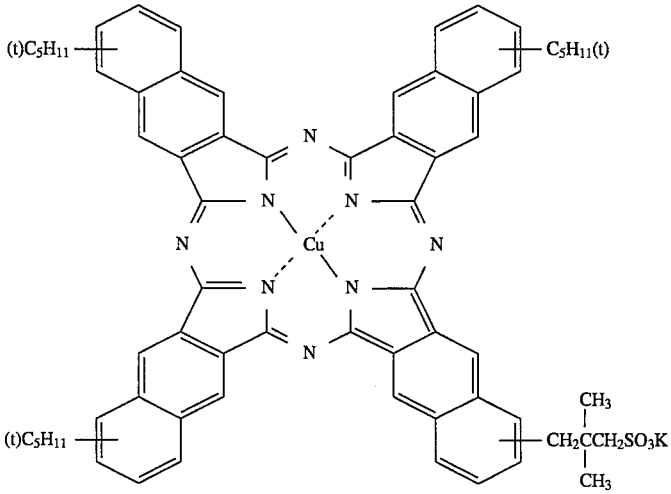

(13)

In addition to the above, the compounds disclosed in Japanese Pat. O.P.I. Pub. Nos. 123454/1987 and 146565/1991 can also be used as near infrared-absorptive dyes.

These water-soluble colorants are dissolved in water together with a water-soluble binder or a water-borne emulsion resin to prepare a light-heat converting layer coating solution. Suitable water-soluble binders are polyvinyl alcohols, polyvinyl pyrrolidones, gelatin, glue, casein, methyl cellulose, hydroxyethyl cellulose, hydroxypropyl cellulose, carboxymethyl cellulose, hydroxyethyl starch, gum arabic, sucrose octacetate, ammonium alginate, sodium alginate, polyvinylamine polyethylene oxides, polystyrenesulfonic acids and polyacrylic acids. Of them, polyvinyl alcohols, methyl cellulose, cellulose derivatives and gelatin are preferrably used.

In order to improve coating properties, a surfactant may be added to the coating solution. There may also be added a material to increase the adhesion between the light-heat converting layer and the lower layer, or a material to improve peelability from the upper layer. Further, at the time of dissolving a water-soluble colorant or a binder, heat or shearing force may be applied thereto to accelerate the dissolution.

The amount of light-heat converting material contained in the light-heat converting layer is usually 2 to 80 wt %, preferably 20 to 70 wt %. The light-heat converting material may also be contained in other layers.

Next, the thermal transfer image receiving material is described.

EXAMPLES

The invention is illustrated by the following examples in which parts are by weight, but the embodiment of the invention is not limited to them.

EXAMPLE 1

Preparation of Ink sheet

An ink sheet was prepared by forming the following cushioning layer, light-heat converting layer and ink layer in order, on a 100-μm thick polyethylene terephthalate support.

(Cushioning layer)

A coating solution was prepared with the following composition and coated with a blade coated to a dry thickness of about 60 μm.

| | |
|---|---|
| JSR0617 (carboxyl-modified styrene-butadiene resin made by Japan Syn. Rubber Co.) | 10 parts |
| Water | 90 parts |

(Light-heat converting layer)

A coating solution was prepared with the following composition and coated with a wire bar coater on the above cushioning layer and dried. The thickness was controlled by measuring the absorbance and comparing the measured value with the relationship between the absorbance of the light-heat converting layer at 830 nm and its thickness, which had been determined in advance.

In case of using a water-soluble light-heat converting material

| | |
|---|---|
| Water-soluble light-heat converting material | 3.50 parts |
| Polyvinyl alcohol GL-05 (product of Nippon Syn. Chem. Co.) | 3.43 parts |

-continued

| | |
|---|---|
| Surfactant FT248 (product of BASF AG) | 0.07 part |
| Water | 93 parts |

In case of using a solvent-soluble light-heat converting material

| | |
|---|---|
| Solvent-soluble light-heat converting material | 3.5 parts |
| Polycarbonate S-2000 (product of Mitsubishi Gas Chem. Co.) | 3.5 parts |
| Methyl ethyl ketone | 93 parts |

(Ink layer)

The following coating solution was coated with a wire bar coater on the above light-heat converting layer and dried.

| | |
|---|---|
| DS-90 (product of Harima Kasei Co.) | 4.7 parts |
| SD0012 (product of Tokyo Ink Mfg. Co.) | 0.5 part |
| EV-40Y (product of Mitsui Du Pont Co.) | 0.5 part |
| Dioctyl phthalate | 0.3 part |
| Brilliant Carmine 6B (magenta dye) | 4.0 parts |
| Methyl ethyl ketone | 90.0 parts |

Preparation of Image Receiving Body

An image receiving body was prepared by forming on a 100-μm thick polyethylene terephthalate support the following layers in order.

(Cushioning layer)

The following coating solution was coated to a dry thickness of about 60 μm with a blade coater.

| | |
|---|---|
| JSR 0617 (product of Japan Syn. Rubber Co.) | 10 parts |
| Water | 90 parts |

(Image receiving layer)

The following coating solution was coated to a dry thickness of 1.0 μm with a wire bar coater on the above cushioning layer.

| | |
|---|---|
| 1,2-polybutadiene resin RB 820 (product of Japan Syn. Rubber Co.) | 10 parts |
| Toluene | 90 parts |

Image Formation by Thermal Transfer

The ink sheet was superposed on the image receiving layer of the image receiving body mounted on a drum, so as to have its ink layer contact with the image receiving layer. Then, the air between the ink sheet and the image receiving body was evacuated with a vacuum pump to obtain a closer contact between them, while squeezing them for making the contact much closer.

Subsequently, the recording material was irradiated with semiconductor laser beams (830 nm) from the ink sheet support side while varying the rotation speed of-the drum. The sensitivity, color reproduction and dot reproduction of the transferred images were evaluated.

EXAMPLE 2

Ink sheets (light-heat converting layer: 0.35 μm thick, ink layer: about 0.7 μm thick, cushioning layer: about 60 μm thick) and image receiving bodies were prepared as in Example 1 except that the light-heat converting materials were changed to the following ones (As binders, S-2000 was used in the solvent-soluble system, and GL-05 in the water-soluble system). The recording materials were subjected to thermal transfer by use of semiconductor laser beams; then, the transferred images were evaluated for sensitivity and color reproduction.

Solvent-soluble light-heat converting materials

A: IR101 (dithiol metal complex salt)

B: IR102

Solvent-dispersible light-heat converting materials

C: IR103 (dispersion of carbon in MEK)

D: IR104 (dispersion of titanyl phthalocyanine in MEK)

Water-soluble light-heat converting materials

E: IR105 (cyanine dye)

F: IR106 (cyanine dye)

G: IR107 (chelate dye)

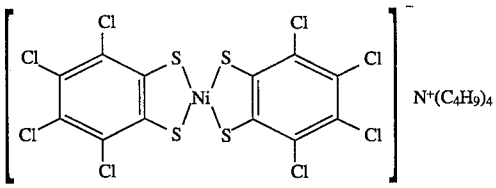

IR101

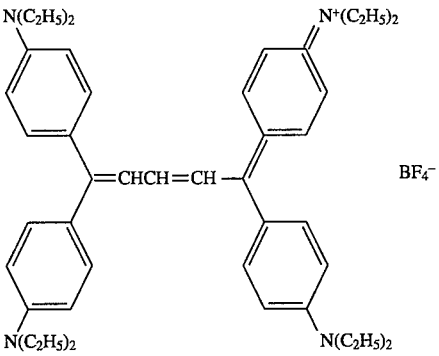

IR102

-continued

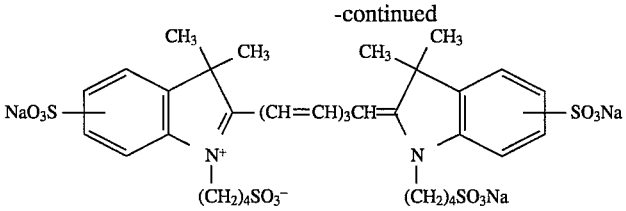

IR105

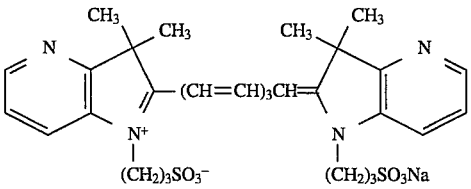

IR106

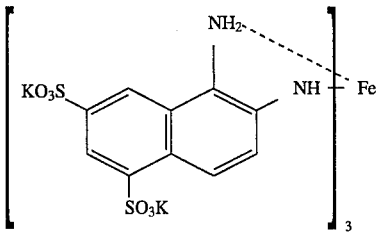

IR107

| Light-heat Converting Material | Sensitivity (mJ/mm$^2$) | Color Reproduction | Remarks |
|---|---|---|---|
| IR101 | 5.00 | apparent color turbidness | Comparison |
| IR102 | 3.00 | apparent color turbidness | Comparison |
| IR103 | 4.00 | apparent color turbidness | Comparison |
| IR104 | 4.50 | apparent color turbidness | Comparison |
| IR105 | 0.50 | no color turbidness | Invention |
| IR106 | 0.50 | no color turbidness | Invention |
| IR107 | 1.50 | slight color turbidness | Invention |

It can be seen from the above results that the use of water-borne light-heat converting materials depresses the color turbidness attributed to light-heat converting materials, and that the use of IR106 is advantageous when sensitivity is taken into consideration.

EXAMPLE 3

Using the following water-soluble binders and solvent-soluble binders as binders for a light-heat converting layer, the sensitivity and color fidelity were evaluated. As light-heat converting materials, IR106 was used together with those water-soluble binders, and IR102 was combined with the solvent-soluble binders.

P1800NT11 (polyether sulfone made by Nissan Chem. Ind.):

sparingly soluble in water, soluble in MEK

U-100 (polyarylate made by Unitika Ltd.):

sparingly soluble in water, soluble in MEK

S-2000 (polycarbonate made by Mitsubishi Gas Chem. Co.):

sparingly soluble in water, soluble in MEK

BESU Resin A515G (polyester made by Takamatsu Yushi Co.):

sparingly soluble in water, soluble in MEK

Polysol AP2681 (styrene-acryl resin, Showa High Polymer):

sparingly soluble in water, soluble in MEK

Ucar AW850 (vinyl chloride-vinyl acetate copolymer, UCC):

sparingly soluble in water, soluble in MEK

TS-625 (gelatin): soluble in water, sparingly soluble in MEK

K-90 (polyvinyl pyrrolidone):

soluble in water, sparingly soluble in MEK

GL-05 (polyvinyl alcohol made by Nippon Syn. Chem. Co. ):

soluble in water, sparingly soluble in MEK

The following results were obtained:

| Binder | Solvent | Sensitivity (mJ/mm$^2$) | Color Reproduction |
|---|---|---|---|
| P1800NT11 | THF/MEK (6/4) | 5.00 | apparent color turbidness |
| U-100 | THF/MEK (6/4) | 5.00 | apparent color turbidness |
| S-2000 | THF/MEK (6/4) | 3.00 | apparent color turbidness |
| BESU Resin A515G | water (dispersion) | 1.00 | slight color turbidness |
| AP2681 | water (dispersion) | 1.50 | slight color turbidness |
| UCAR AW850 | water (dispersion) | 1.00 | slight color turbidness |
| TS-625 | water | 0.75 | no color turbidness |
| K-90 | water | 0.75 | no color turbidness |
| GL-05 | water | 0.50 | no color turbidness |

As is apparent from the above results, using a water-borne binder as binder for the light-heat converting layer can improve the color fidelity.

EXAMPLE 4

Ink sheets were prepared according to the procedure of Example 1, except that IR105 was used as water-soluble light-heat converting material and GL-05 as binder. In the preparation, the thickness of the light-heat converting layer was varied within the range of 0.1 to 3.0 μm, and the thickness of the ink layer within the range of 0.3 to 2.0 μm. These thicknesses were determined by measuring the absorbances at 830 nm for the light-heat converting layer and at 570 nm for the ink layer, respectively.

The relationship between the light-heat converting layer thickness and the sensitivity was as follows:

| Binder Layer Thickness (μm) | Ink Layer Thickness (μm) | Sensitivity (mJ/mm$^2$) |
|---|---|---|
| 0.10 | 0.70 | 0.40 |
| 0.20 | 0.70 | 0.40 |
| 0.25 | 0.70 | 0.40 |
| 0.30 | 0.70 | 0.50 |
| 0.35 | 0.70 | 0.50 |
| 0.40 | 0.70 | 0.61 |
| 0.60 | 0.70 | 0.75 |
| 0.80 | 0.70 | 1.00 |
| 1.10 | 0.70 | 3.25 |
| 1.50 | 0.70 | 3.50 |
| 2.00 | 0.70 | 4.00 |
| 3.00 | 0.70 | 4.50 |
| 0.35 | 0.30 | 0.50 |
| 0.35 | 0.40 | 0.50 |
| 0.35 | 0.60 | 0.50 |
| 0.35 | 0.90 | 0.75 |
| 0.35 | 1.10 | 1.25 |
| 0.35 | 1.50 | 1.25 |
| 0.35 | 2.00 | 1.25 |

The degree of heat resistance required of materials for the light-heat converting layer cannot be simply fixed because it depends upon the amount of energy supplied, but it was confirmed that the heat resistance could be improved by use of water-soluble compounds in systems comprising similar types of polymer binders, light-heat converting dyes and additives.

Further, when a water-soluble light-heat converting layer is used, the light-heat converting layer is scarcely affected in coating thereon an ink layer composition, providing the component layers in good condition and thereby facilitating the formation of images in high sensitivity and less color turbidness.

EXAMPLE 5

Preparation of Ink Sheet

An ink sheet was prepared by forming the following cushioning layer, adhesive layer, light-heat converting layer and ink layer in order on a 50-μm thick transparent polyethylene terephthalate (Diafoil T-100 made by Hoechst AG) support.

Cushioning layer

The following coating solution for cushioning layer was coated so as to be a dry coating thickness of 5 μm.

| Coating solution for cushioning layer | |
|---|---|
| Polyester (Vylon 200 made by Toyobo Co.) | 20 parts |
| MEK | 64 parts |
| Toluene | 16 parts |

Adhesive layer

The following coating solution for adhesive layer was coated so as to be a dry coating thickness of 0.5 μm.

| Coating solution for adhesive layer | |
|---|---|
| Polyester. (Pluscoat Z-446 made by Gooh Kagaku Kogyo Co.) | 5 parts |
| Water | 45 parts |
| Ethanol | 50 parts |

Light-heat converting layer

The following coating solution for light-heat converting layer was coated so as to give a absorbance of 1.0 at a wavelength of 800 nm and dried at 40° C. The resulting coating thickness was about 0.3 μm.

| Coating solution for light-heat converting layer | |
|---|---|
| Gelatin | 3.38 parts |
| Citric acid | 0.02 part |
| Surfactant (compound 1) | 0.05 part |
| Glyoxal (hardener) | 0.02 part |
| Infrared-absorptive dye (IR-1) | 1.4 parts |
| Sodium acetate | 0.13 part |
| Deionized water | 90 parts |
| Ethanol | 5 parts |

Ink layer

The following coating solution for ink layer was coated so as to give a dry coating thickness of 0.4 μm.

| Coating solution for ink layer | |
|---|---|
| Magenta pigment MEK dispersion | 4 parts |
| Styrene-acrylic resin (SBM-100 made by Sanyo Chem. Ind. CO) | 4.8 parts |
| EVA (EV-40Y made by Mitsui Du Pont Co.) | 0.5 part |
| Dioctyl phthalate | 0.3 part |
| Silicone resin particles (TOSUPARU 108 made by Toshiba Silicone Co.) | 0.3 part |
| Fluorine-containing surfactant (SURFURON S-382 made by Asahi Glass Co.) | 0.1 part |
| MEK | 80 parts |
| Cyclohexanone | 10 parts |

Surfactant (Compound 1)

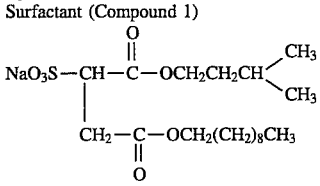

IR-1

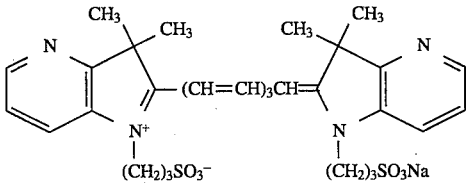

λmax 740 nm (MeOH)

Preparation of Image Receiving Sheet

An image receiving sheet was prepared by coating the following coating solution for image receiving layer to a dry thickness of 1.0 μm on a base obtained by laminate coating of the above EVA (P1407C) to a 30-mm thickness on the above 50-μm thick polyethylene terephthalate film.

| Coating solution for image receiving layer | |
|---|---|
| Styrene-acrylic resin (SBM-100 made by Sanyo Chem. Ind. CO) | 9.2 parts |
| EVA (EV-40Y made by Mitsui Du Pont Co.) | 0.5 part |
| Silicone resin particles (TOSUPARU 108 made by Toshiba Silicone Co.) | 0.3 part |
| MEK | 70 parts |
| Cyclohexanone | 20 parts |

Image Formation

Figure 1:
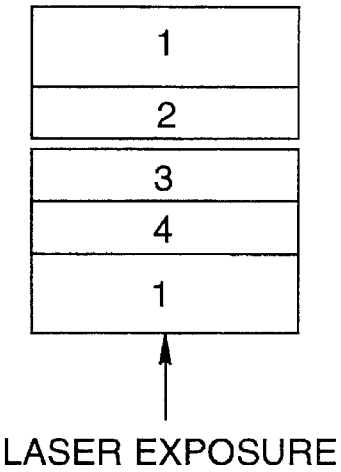
FIG. 1: cross sectional views each showing a schema of thermal transfer using a heat mode thermal transfer recording material of the invention superposed on an image receiving material
Figure 1:
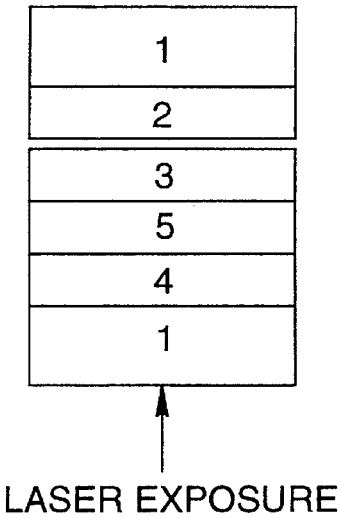
Figure 1:
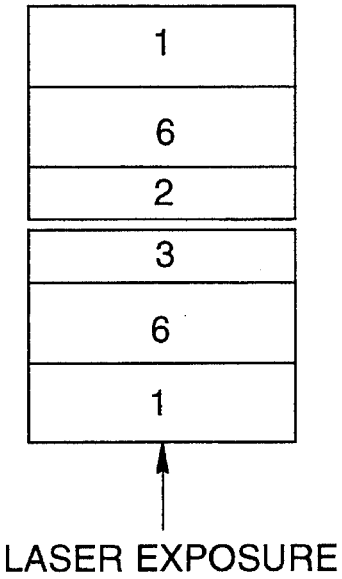
Figure 1:
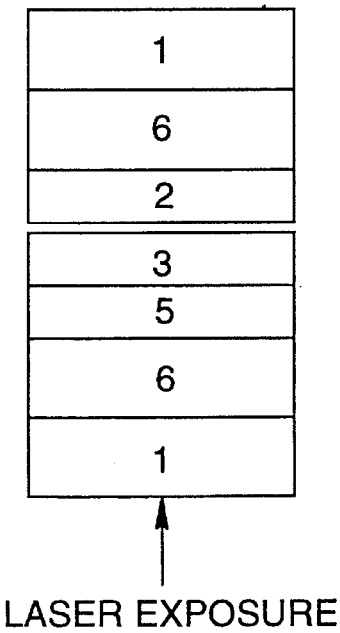

The ink layer of the above ink sheet and the image receiving layer of the image receiving sheet were brought into contact with each other, wound around the drum-shaped evacuator shown in FIG. 1, subjected to vacuum contacting at 400 Torr and exposed with a semiconductor laser having an oscillation wavelength of 830 nm. After completing the exposure, the image receiving sheet was peeled from the ink sheet and the image transferred thereto was examined. The optical system of the apparatus used for image formation comprised a 100-mW semiconductor laser capable of irradiating a beam condensed to 6 μm in diameter ($1/e^2$ of the peak power) and having a laser power of 33 mW at the irradiated face. The primary scanning was carried out by rotating the drum-shaped evacuator having a circumference of 33 inches, and the secondary scanning was made by shifting the optical system synchronously with the drum rotation. The transferring property was evaluated by repeating exposures at varied rotation speeds of the drum.

Evaluation

The ink sheet prepared as above had a uniform light-heat converting layer formed in good condition without any uneven density and discoloration. Image formation by use of this ink sheet also produced good results, causing neither scatter nor transfer of the light-heat converting layer and allowing images free from color turbidness to be formed at a drum rotation speed of 245 rpm. Further, the performance of the the ink sheet did not change even after the storage at 40° C. and 80% RH for 3 days.

EXAMPLE 6

An ink sheet and an image receiving sheet were prepared in the same manner as in Example 5, except that the light-heat converting layer was formed by being dried at 60° C.

Evaluation

The resulting ink sheet had a uniform light-heat converting layer formed in good condition without any uneven density and discoloration. Image formation by use of this ink sheet also produced good results, causing neither scatter nor transfer of the light-heat converting layer and allowing images free from color turbidness to be formed at a drum rotation speed of 245 rpm. Further, the performance of the the ink sheet did not change even after the-storage at 40° C. and 80% RH for 3 days.

EXAMPLE 7

An ink sheet and an image receiving sheet were prepared in the same manner as in Example 5, except that the light-heat converting layer was formed by being dried at 80° C.

Evaluation

A little discoloration was observed and portions tinted blue were found locally in the light-heat converting layer of the resulting ink sheet. But image formation by use of this ink sheet gave good results, causing neither scatter nor transfer of the light-heat converting layer and allowing images free from color turbidness to be formed at a drum rotation speed of 245 rpm. Further, the performance of the the ink sheet did not change even after the storage at 40° C. and 80% RH for 3 days.

EXAMPLE 8

An ink sheet and an image receiving sheet were prepared in the same manner as in Example 5, except that the following coating solution for light-heat converting layer was used.

| Coating solution for light-heat converting layer | |
|---|---|
| Gelatin | 2.88 parts |
| Citric acid | 0.02 part |
| Surfactant (compound 1) | 0.05 part |
| Glyoxal | 0.02 part |
| Fluorine-containing surfactant (FURORADO FC-430 made by Sumitomo 3M Co.) | 0.5 part |
| Infrared-absorptive dye (IR-1) | 1.4 parts |
| Sodium acetate | 0.13 part |
| Deionized water | 90 parts |
| Ethanol | 5 parts |

Evaluation

The resulting ink sheet had a uniform light-heat converting layer free from uneven density and discoloration. In forming images by use of this ink sheet, the light-heat converting layer did not scatter or transfer at all, and images having no color turbidness could be formed at a drum rotation speed of 280 rpm. After the storage at 40° C. and 80% RH for 3 days, the performance of-the ink sheet was found to be unchanged.

What is claimed is:

1. A heat mode thermal transfer recording material comprising a) a support;

b) a light-heat converting layer comprising 1) a water-soluble near infrared-absorptive dye having a sulfo group; and 2) a water soluble binder;

c) an ink layer containing a colorant and a binder which can be softened or melted upon heating, and transferred; and d) a cushioning layer;

wherein said water-soluble near infrared-absorptive dye has an absorption peak at wavelengths longer than 700 nm and the water solubility of said dye is not less than 0.1% by weight of water, and said light-heat converting layer is disposed between said support and said ink layer.

2. The heat mode thermal transfer recording material of claim 1, wherein said water-soluble binders are selected from the group consisting of polyvinyl alcohols, polyvinyl pyrrolidone, gelatin, glue, casein, methyl cellulose, hydroxyethyl cellulose, hydroxypropyl cellulose, carboxymethyl cellulose, hydroxyethyl starch, gum arabic, sucrose octacetate, ammonium alginate, sodium alginate, polyvinylamine polyethylene oxides, polystyrenesulfonic acids and polyacrylic acids.

3. The heat mode thermal transfer recording material of claim 2, wherein said water-soluble binder is a binder selected from the group consisting of a gelatin, a polyvinyl alcohol, and a methyl cellulose.

4. The heat mode thermal transfer recording material of claim 1, wherein the thickness of the ink layer is not more than 1.0 μm.

5. The material of claim 1, wherein said light-heat converting layer comprises said water-soluble near infrared-absorptive dye in an amount of 2 to 80% by weight.

6. The heat mode thermal transfer recording material of claim 1, wherein the thickness of said ink layer is within the range of 0.2 to 2 μm.

7. The heat mode thermal transfer recording material of claim 1, wherein the thickness of said light-heat converting layer is within the range of 0.1 to 3 μm.

8. The heat mode thermal transfer recording material of claim 1, wherein the thickness of said cushioning layer is within the range of 1 to 50 μm.

9. The heat mode thermal transfer recording material of claim 1, wherein the thickness of said support is within the range of 5 to 200 μm.

10. The heat mode thermal transfer recording material of claim 1, wherein a backing layer is provided on the reverse side of said support.

11. The heat mode thermal transfer recording material of claim 1, wherein the thickness of said light-heat converting layer is not more than 1.0 μm, and the absorbance of said light-heat converting layer is 0.3 to 3.3 at a wavelength longer than 700 nm.

12. The heat mode thermal transfer recording material of claim 11, wherein said absorbance of said light-heat converting layer is 0.7 to 2.5 at a wavelength longer than 700 nm.

* * * * *